US005650602A

United States Patent [19]

Wood et al.

[11] Patent Number: 5,650,602

[45] Date of Patent: Jul. 22, 1997

[54] CIRCUIT INTERRUPTING APPARATUS AND METHOD FOR HIGH CURRENT POWER LINES

[75] Inventors: Eugene H. Wood; Michael G. Nolte; Ronny D. Jergenson, all of Hickory, N.C.

[73] Assignee: Utility Solutions, Inc., Hickory, N.C.

[21] Appl. No.: 483,187

[22] Filed: Jun. 7, 1995

[51] Int. Cl.[6] ..... H01H 33/04

[52] U.S. Cl. ..... 218/12; 200/17 R

[58] Field of Search ..... 81/38, 53.1; 200/17 R, 200/50.1; 218/1–21; 294/19 R–22; 337/156, 168, 171, 174–176, 194, 202, 203, 208, 211–214, 417

[56] References Cited

U.S. PATENT DOCUMENTS

| | | | |
|---|---|---|---|
| 2,671,142 | 3/1954 | Lindell | 200/146 |
| 2,816,981 | 12/1957 | Lindell | 200/114 |
| 2,816,983 | 12/1957 | Lindell | 200/114 |
| 2,816,984 | 12/1957 | Lindell | 200/114 |
| 2,816,985 | 12/1957 | Lindell | 200/115.5 |
| 2,824,190 | 2/1958 | Mikos | 200/114 |
| 2,917,608 | 12/1959 | Mikos | 200/146 |
| 2,917,609 | 12/1959 | Mikos | 200/146 |
| 2,985,737 | 5/1961 | Mikos | 200/114 |
| 3,032,630 | 5/1962 | McCloud et al. | 200/114 |
| 3,090,853 | 5/1963 | McDonald | 200/114 |
| 3,235,688 | 2/1966 | Fink et al. | 200/114 |
| 3,377,447 | 4/1968 | Hermann et al. | 200/114 |
| 4,480,244 | 10/1984 | Manning | 337/171 |

*Primary Examiner*—Michael L. Gellner
*Assistant Examiner*—Michael A. Friedhofer
*Attorney, Agent, or Firm*—Bell, Seltzer, Park & Gibson, P.A.

[57] ABSTRACT

A portable circuit interrupting apparatus for use in association with a circuit isolating device such as a fuse cutout, disconnecting switch, or power fuse. The apparatus has a tubular housing, with a sleeve coaxially and slidably mounted within the housing. A ring engaging terminal is mounted to the housing and engages a ring-like conducting part of the isolating device, and a hook engaging terminal is mounted to the sleeve and engages a hook-like conducting part of the isolating device. The ring engaging terminal is mounted to the housing by a tubular cylinder fixed to the housing, and a shuttle slidably mounted in the tubular cylinder and so as to be lockable in each of at least two axially spaced apart positions, and the ring engaging terminal is fixed to the shuttle. A shunting circuit is connected between the ring engaging and the hook engaging terminal and includes a circuit segment positioned within the housing which is automatically interrupted upon the sleeve being moved to a withdrawn position.

17 Claims, 3 Drawing Sheets

CIRCUIT INTERRUPTING APPARATUS AND METHOD FOR HIGH CURRENT POWER LINES

BACKGROUND OF THE INVENTION

The present invention relates to a portable circuit interrupting apparatus of the type used to open high voltage circuit isolating devices, such as fuse cutouts, disconnecting switches, power fuses, and the like.

Circuit isolating devices of the described type are adapted to be periodically opened to provide necessary service, such as fuse replacement or service to the power lines. Conventionally, such circuit isolating devices include a ring-like conducting part and a hook-like conducting part which are relatively movable between a contacting position for establishing a closed circuit through the device, and a separated position for establishing an open circuit through the device.

When it is necessary to open the circuit isolating device while it is carrying load current, an arc is drawn between the two conducting parts, which is likely to damage any components which are contacted by the arc. Also, where other adjacent circuits are involved, the drawn arc may jump to another circuit, causing a fault in the other circuit. Still further, the drawn arc can jump to the operator, causing serious injury.

To minimize the risks and dangers associated with the opening of such circuit isolating devices, specially designed portable circuit interrupting apparatuses have been developed, as described for example in U.S. Pat. Nos. 2,816,984 and 2,816,985. These apparatuses typically comprise a rod-like terminal which enters the ring-like conducting part of the isolating device and a second terminal which loops about the hook-like conducting part. The interrupting apparatus is mounted at the upper end of an elongate line pole, and in use, the operator initially lifts the apparatus to an elevated position adjacent the isolating device while holding the lower end of the line pole, and the operator then swings the interrupting apparatus into engagement with the isolating device so as to bring the two terminals of the interrupting apparatus into proper contact with the two conducting parts of the isolating device. Upon then pulling downwardly on the line pole, the operator is able to separate the two conducting parts of the isolating device to open the circuit and so that the current then flows through a shunt circuit which is located in the interior of the interrupting apparatus. The interrupting apparatus further incorporates a shunt circuit interrupter, which opens the shunt circuit inside the apparatus, and so that the resulting arc is confined to the interior of the apparatus.

The interrupting apparatuses of the type described above and as illustrated and described in the above-referenced patents, must be carefully manipulated during their initial engagement with the isolating device, so that the two terminals properly engage the two conducting parts of the isolating device. This typically requires the hook engaging terminal of the interrupting apparatus to initially engage the hook-like conducting part of the isolating device, and the interrupting apparatus is then swung laterally so that the ring engaging terminal of the interrupting apparatus enters the ring-like conducting part of the isolating device. Thus, a two-step movement of the interrupting apparatus is required to properly engage the two terminals with the two conducting parts of the isolating device. This can be difficult in actual practice, since the operator will often be required to carefully manipulate the apparatus while it is located several feet above the operator and on the upper end of the line pole.

A further disadvantage of the present interrupting apparatuses is the fact that they are sized to match the size of a particular isolating device, and thus a separate and properly sized interrupting apparatus is required for differently sized isolating devices.

It is accordingly an object of the present invention to provide a circuit interrupting apparatus of the described type which significantly alleviates the above noted disadvantages and limitations of the prior art apparatuses.

It is a more particular object of the present invention to provide a circuit interrupting apparatus and a method of utilizing the same and wherein the apparatus may be joined to the isolating device with a simple lateral thrust of the apparatus toward the isolating device, and wherein the ring engaging terminal initially enters the ring-like conducting part, and thereafter serves to guide the hook engaging terminal into operative engagement with the hook-like conducting part of the isolating device as the lateral thrust continues.

SUMMARY OF THE INVENTION

The above and other objects and advantages of the present invention are achieved by the provision of a portable circuit interrupting apparatus which comprises a tubular housing defining a central axis, and a sleeve coaxially mounted to the housing and so as to be slidable between an inserted position and a withdrawn position. A spring biasing means is provided for biasing the sleeve in a first direction extending from the withdrawn position toward the inserted position.

An elongate ring engaging terminal is mounted to the housing such that the terminal axis at all times substantially perpendicularly intersects said central axis, and a hook engaging terminal is mounted to the sleeve. A shunting circuit means is connected between the ring engaging terminal and the hook engaging terminal and includes a circuit segment positioned within the housing and sleeve, and means for automatically interrupting the circuit segment upon the sleeve being moved to and reaching the withdrawn position.

A line pole connector arm is also provided which includes means for attaching an elongate line pole thereto, and means mounting the line pole connector arm to the housing, such that the line pole is adapted to be manually engaged by the operator of the apparatus and the apparatus can be remotely manipulated by the operator.

The means mounting the line pole connector arm to the housing includes a pivotal connection therebetween, which is positioned such that the line pole connector arm is pivotable about an axis which perpendicularly intersects the central axis of the housing.

Also, in the preferred embodiment, the ring engaging terminal comprises an elongate rod-like member which is essentially linear, and the hook-engaging terminal comprises a closed ring-like member. Further, the ring engaging terminal preferably extends radially outwardly a distance from the central axis which is at least about twice the distance which the hook engaging terminal extends from the central axis.

In use, the operator is able to readily manipulate the interrupting apparatus so that the ring engaging terminal and the hook engaging terminal are connected to the ring-like conducting part and the hook-like conducting part of the circuit isolating device respectively. In this regard, and as an important feature of the invention, the ring engaging terminal and the hook engaging terminal are oriented with respect to each other, and separated a predetermined distance from each other, when the sleeve is in its inserted position, so as to permit the ring engaging terminal to enter the ring-like conducting part of the circuit isolating device and thereby guide the hook engaging terminal into operative engagement with the hook-like conducting part of the circuit isolating device, upon a continuous lateral thrust of the circuit interrupting apparatus toward the circuit isolating device. Thus, the interrupting apparatus of the present invention may be readily joined to the circuit isolating device with a single lateral thrust of the tool toward the isolator device, and without the need for the careful manipulation of each terminal into operative contact with the associated conducting part of the isolating device.

Once the interrupting apparatus is joined to the isolating device, the operator pulls down on the line pole, which causes the sleeve to be moved from the inserted position to the withdrawn position against the force of the spring biasing means. Upon initial movement of the sleeve from its inserted position to its withdrawn position, the ring engaging terminal and the hook engaging terminal will be moved apart to thereby separate the ring-like conducting part and the hook-like conducting part of the circuit isolating device and thereby open the circuit therebetween and while momentarily maintaining a shunting circuit through the shunting circuit means. Upon the sleeve reaching the withdrawn position the circuit segment of the shunting circuit means will be opened, and so that the resulting arc is protectively retained within the housing of the interrupting apparatus.

As a further feature of the preferred embodiment of the invention, a release pin is mounted on the tubular housing for automatically and releasably locking the sleeve in its withdrawn position, so as to maintain a maximum electrical clearance between the ring engaging terminal and the hock engaging terminal after the circuit is opened. Also, the ring engaging terminal is preferably mounted to a slidable shuttle, which is movable between upper and lower positions, and a release pin is provided for releasably locking the shuttle in the upper position and a further release pin is provided for automatically and releasably locking the shuttle in the lower position. Thus during the circuit opening operation, the shuttle and thus the ring engaging terminal move downwardly with respect to the housing, while the sleeve and the hook engaging terminal move in the opposite direction, and both the shuttle and the sleeve are automatically locked at the point of maximum electrical clearance between the two terminals.

BRIEF DESCRIPTION OF THE DRAWINGS

Some of the objects and advantages of the present invention having been stated, others will appear as the description proceeds when considered in conjunction with the accompanying drawings in which.

DETAILED DESCRIPTION OF THE PREFERRED EMBODIMENT

Figure 1:
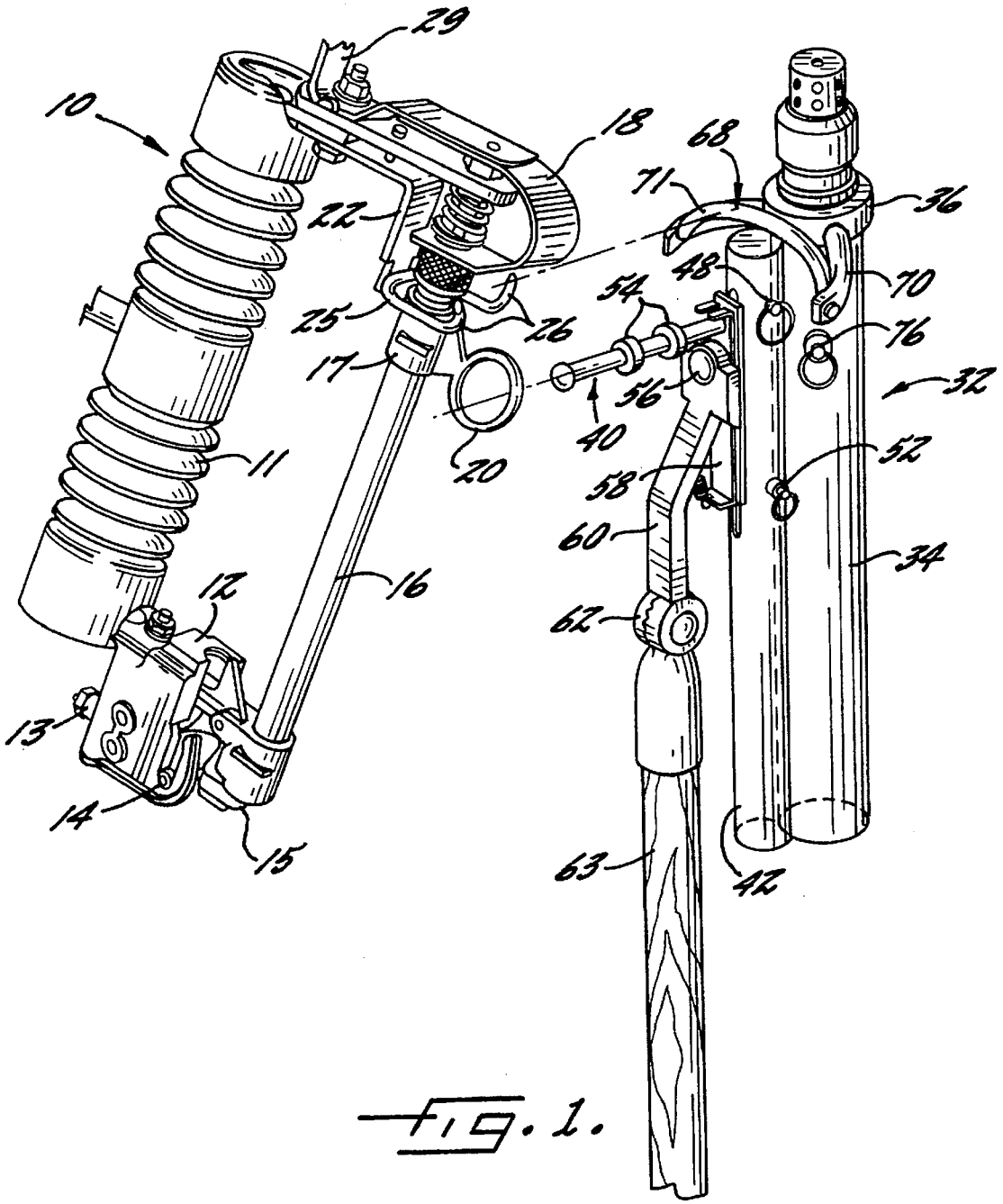
FIG. 1 is a perspective view of a circuit isolating device and a circuit interrupting apparatus of the present invention, and illustrating an initial portion of the step of joining the interrupting apparatus to the isolating device.
Figure 2:
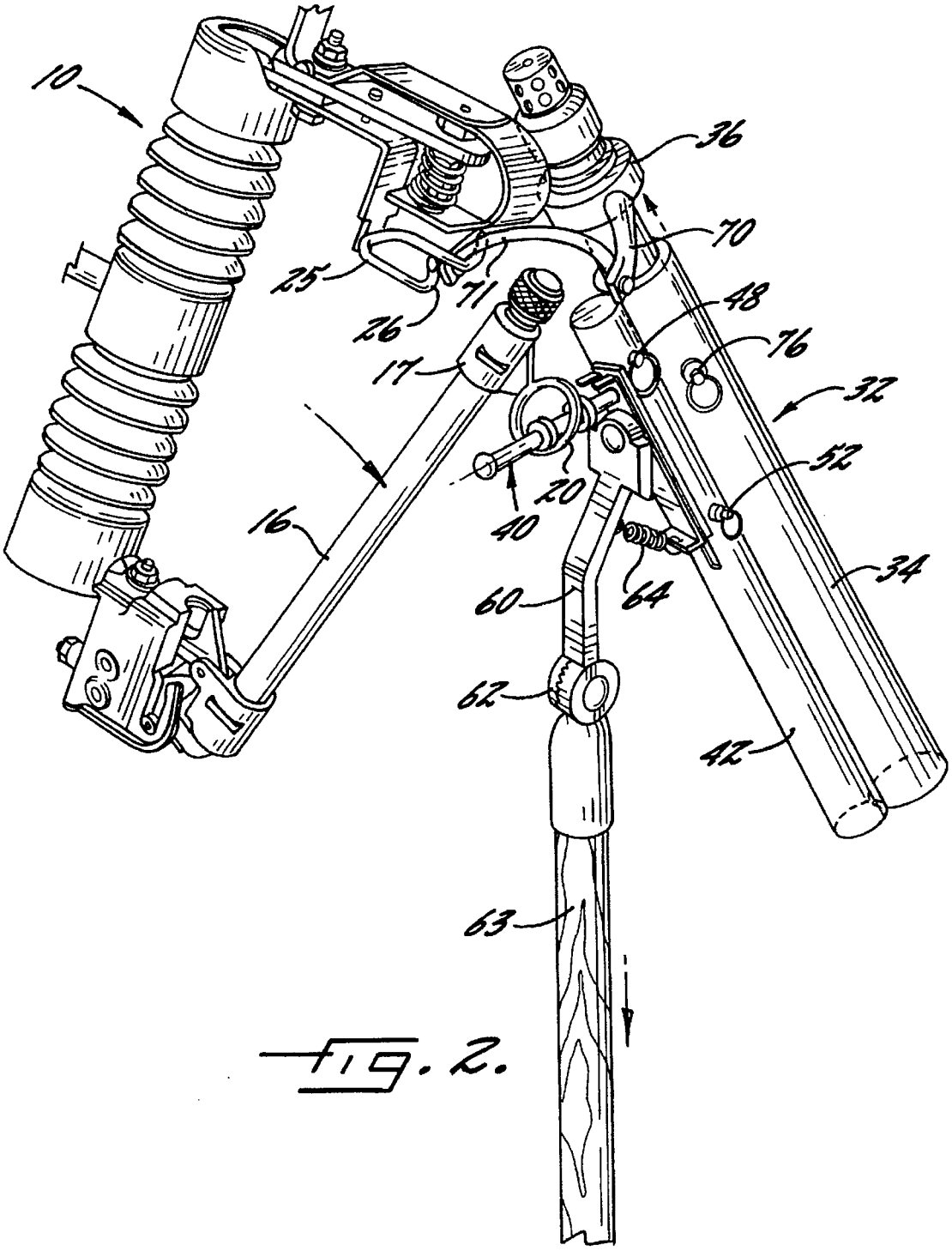
FIG. 2 is a view similar to FIG. 1 and illustrating the interrupting apparatus joined to the circuit isolating device and with the circuit isolating device having been moved to its opened position and at about the point where the shunting circuit in the interrupting apparatus is interrupted.

Referring more particularly to the drawings, a circuit isolating device of the disconnecting fuse type is indicated generally at 10 in FIGS. 1–2. The circuit isolating device 10 is conventional, and the details of its construction are more fully set forth in U.S. Pat. Nos. 2,745,923 and 2,816,984, the disclosures of which are expressly incorporated herein by reference. Thus only a general description of the device is set forth herein.

The circuit isolating device includes an insulator 11 which is arranged to be stationarily mounted on a cross arm or the like and has a lower terminal contact member 12 carrying a connector 13 for connection to a line terminal. Pivoted at 14 on the lower terminal contact member is a lower current carrying member 15 that is positioned at the lower end of a fuse tube 16. At its upper end, the fuse tube 16 has an upper current carrying member 17 which is positioned in contact engagement with a normally energized contact member 18 carried by the upper end of the insulator 11. In order to remove the upper current carrying member 17 from contact engagement with the terminal contact member 18, the former is provided with a ring-like conducting part 20.

The terminal contact member 18 includes an L-shaped reinforcing bar 22 having a downwardly extending arm which carries a hook-like conducting part 25. The part 25 is shaped, in part, for guiding the upper current carrying member 17 into proper contact engagement with the terminal contact member 18. The part 25 includes forwardly extending arms 26 at the outer ends of which are transversely extending horns or studs. Provision is also made for connecting an energized line conductor (not shown) to the terminal contact 18 and the bar 22 through a terminal pad 29.

Figures 3, 4:
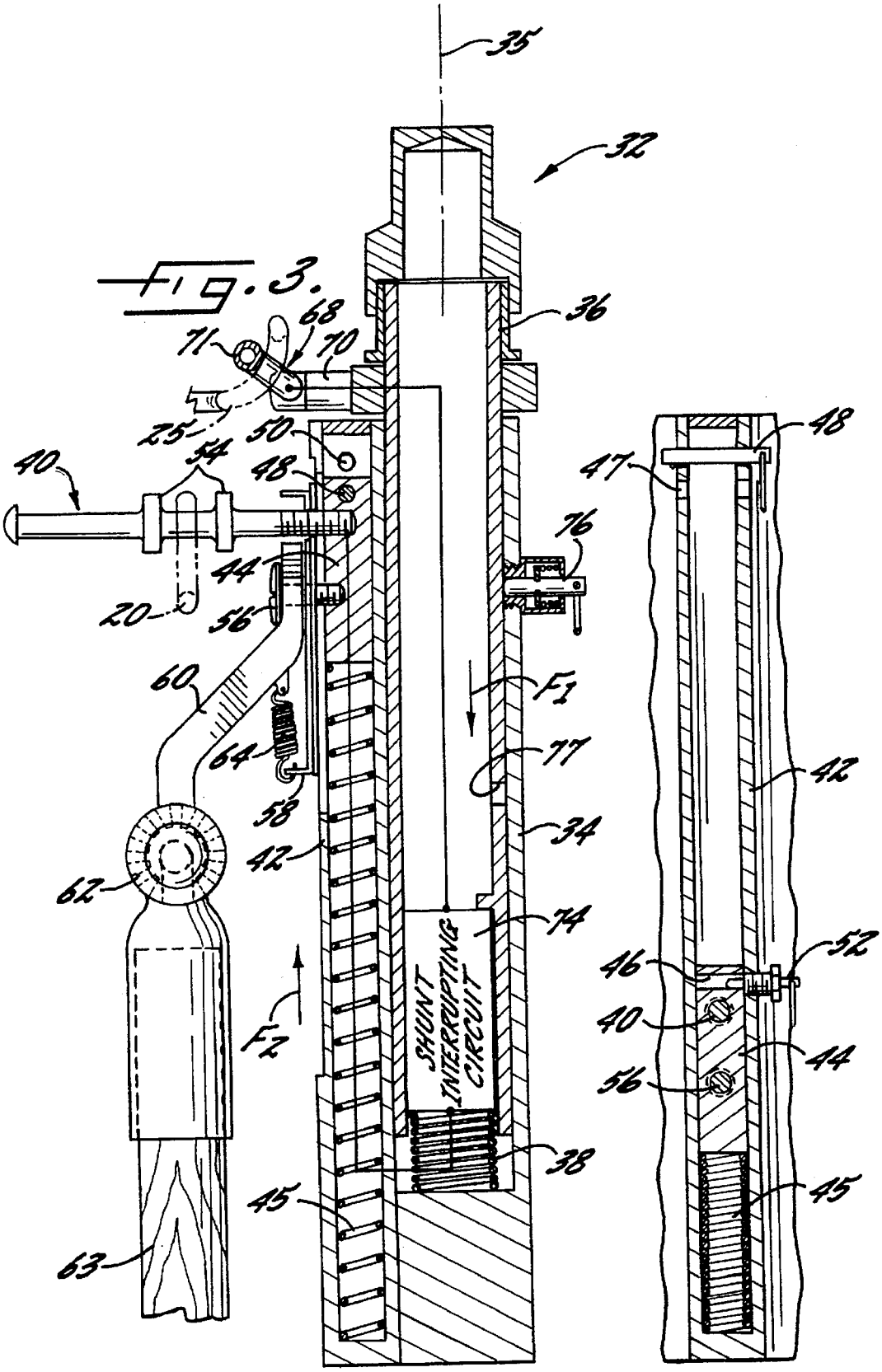
FIG. 3 is a partly schematic cross-sectional view of a circuit interrupting apparatus which embodies the present invention.
FIG. 4 is a fragmentary cross sectional view taken at right angles to FIG. 3 and illustrating the interior components of the tubular cylinder of the interrupting apparatus.

In accordance with the present invention, a circuit interrupting apparatus 32 is provided for safely and expeditiously opening the circuit isolating device 10 while it is carrying line current. The circuit interrupting apparatus 32 comprises a tubular housing 34 which defines a central axis 35, and a sleeve 36 which is coaxially mounted in the housing 34 and so as to be slidable between an inserted position as seen in FIGS. 1 and 3 and a withdrawn position as shown in FIG. 2. Spring biasing means as schematically illustrated at 38 is provided for biasing the sleeve 36 in a first direction F1 extending from the withdrawn position toward the inserted position.

A ring engaging terminal 40 is mounted to the housing 34 in the manner best seen in FIG. 3. More particularly, there is provided a tubular cylinder 42 which is mounted to the exterior wall of the tubular housing 34, so as to be parallel to the central axis 35. The tubular cylinder 42 in turn slidably mounts a shuttle 44 in the interior thereof, and a spring 45 is positioned below the shuttle so as to bias the shuttle upwardly in the direction F2 as seen in FIG. 3.

The shuttle 44 is movable between two fixed positions as seen in FIGS. 3 and 4, with the upper position shown in FIG. 3 and the lower position shown in FIG. 4. To be able to lock the shuttle in each of these positions, the shuttle is provided with an opening 46 therethrough, and matching transverse openings 47 are provided in the wall of the tubular cylinder 42. Also, a transverse pin 48 is removably mounted to extend through the transverse openings 47 and the opening 46 of the shuttle 44 so as to releasably lock the shuttle in the upper position as illustrated in FIG. 3. To move the shuttle to its second or lower position, the pin 48 is withdrawn and placed at a storage location defined by a second pair of transverse openings 50 through the tubular cylinder 42, and as seen in FIG. 4. The shuttle 44 may then be moved downwardly to the second position, against the force of the spring 45, and until the release pin 52 automatically engages in the opening 46 of the shuttle.

The ring engaging terminal 40 takes the form of an elongate rod-like member which is essentially linear and includes a pair of axially spaced apart discs 54 at a medial location along its length. The terminal 40 thus defines a terminal axis, and it is threadedly mounted to the shuttle 44 so that its terminal axis at all times substantially perpendicularly intersects the central axis 35 of the housing 34, even when the shuttle 44 moves between its upper and lower positions. In this regard, the terminal 40 extends outwardly through a vertical slot in the wall of the tubular cylinder 42, which precludes rotation of the shuttle 44 about the axis of the tubular cylinder 42. Also, in view of its threaded connection to the shuttle, the terminal 40 may be removed and replaced with a terminal having a different length or configuration, so as to best engage the particular isolating device being serviced.

The shuttle 44 also mounts a pivot pin 56 which extends parallel to and below the terminal 40, and the pivot pin 56 extends through a plate 58 and pivotally supports a line pole connector arm 60. The connector arm 60 includes a mounting post 62 by which a line pole 63 may be fixed thereto, as illustrated in the drawings. A spring 64 is interconnected between the connector arm 60 and the plate 58, so as to limit the pivotal movement of the connector arm 60 about the axis of the pivot pin 56, and return the arm to a neutral position.

The circuit interrupting apparatus 32 further includes a hook engaging terminal 68 in the form of a closed ring-like member or eye, which is mounted to the sleeve 36. The terminal 68 is composed of a pair of rigid arms 70 extending outwardly from the sleeve, and an outer arcuate portion 71 which is mounted for pivotal movement between the rigid arms and for pivotal movement about an axis which is perpendicular to but spaced from the central axis 35 of the housing.

A shunting circuit 74 is connected between the ring engaging terminal 40 and the hook engaging terminal 68 as illustrated schematically in FIG. 3. The shunting circuit 74 includes a circuit segment positioned within the housing 34 and sleeve 36 and includes provision for automatically interrupting the circuit segment upon the sleeve 36 being moved to and reaching its withdrawn position. A circuit interrupting means of this type is well known in the art, and is described for example in U.S. Pat. Nos. 2,816,984 and 2,816,985, the disclosures of which are expressly incorporated herein by reference.

The tubular housing 34 also mounts a release pin 76 which is adapted to enter an opening 77 in the wall of the sleeve 36 when the sleeve is moved to its withdrawn position. Thus the sleeve will be locked in its withdrawn position, until the pin 76 is manually released, which permits the spring 38 to return the sleeve to its inserted position.

FIGS. 1–2 illustrate the sequence by which the circuit interrupting apparatus 32 of the present invention is used to open a circuit isolating device 10, while avoiding damage or injury from the resulting arc. Initially, and as illustrated in FIG. 1, the apparatus 32 is lifted on the line pole 63 to a position adjacent the isolating device 10. The operator then aligns the ring engaging terminal 40 with the ring-like conducting part 20 of the isolating device, and then moves the apparatus 32 laterally in a continuous thrust so that the terminal 40 initially enters the ring-like conducting part 20. With continuing lateral movement, the terminal 40 guides the apparatus 32 so that the hook engaging terminal 68 properly and automatically engages the hook-like conducting part 25. The operative interconnection of the two devices is then complete.

Next, the operator pulls downwardly on the line pole 63, causing the ring-like conducting part 20 to move forwardly and separate the upper current carrying member 17 from the contact member 18, note FIG. 2. This separation breaks the circuit through the device 10 but the circuit remains closed by reason of the shunting circuit 74 through the apparatus 32. Also, the pair of discs 54 in the mid portion of the terminal 40 acts to maintain its connection to the ring-like conducting part 20 during this downward movement. The two discs 54 also provide the user with a locating method which is positive and leaves no doubt the apparatus is in the proper position for operation.

Continued downward movement of the line pole 63 causes the sleeve 36 to be axially withdrawn from the housing 34 against the biasing force of the spring 38, and by reason of the arcuate movement of the terminal 40, the housing 34 will pivot away from the connector arm 60 about the axis of the pivot pin 56, as seen in FIG. 2. When the sleeve 36 reaches a predetermined withdrawn position, the shunting circuit 74 is interrupted inside the housing 36, so as to protectively contain the resulting arc.

For most standard isolating units, the shuttle 44 will be locked in the upper position by means of the pin 48 as seen in FIG. 3, which by design places the terminal 40 at a proper position for ensuring engagement of the two terminals 40, 68 with the two conducting parts 20, 25 during the initial joining step as described above. Where larger isolating devices 10 are to be serviced, the shuttle 44 is freed by the removal of the pin 48. The shuttle thus is initially held at its upper position by the spring 45 as shown in FIG. 3, but it slides downwardly during the circuit opening operation and is locked in the lowered position by the pin 52 automatically entering the opening 46 as seen in FIG. 3. In this regard, the strength of the spring 45 engaging the shuttle 44, and the strength of the spring 38 engaging the sleeve 36 are coordinated, in order to permit the shuttle 44 to slide concurrently with the withdrawal of the sleeve 36. Also, when the shuttle is fully lowered, it is locked by the pin 52 automatically entering the opening 46, and when the sleeve 36 is fully withdrawn it is automatically locked by the pin 76 entering the opening 77.

Further, the springs 45 and 38 are engineered so that the shuttle 44 is fully lowered and locked prior to the interruption of the shunting circuit 74. Thus a maximum electrical clearance between the terminals 40 and 68 is assured before the circuit is interrupted and open.

The fact that the shuttle 44 and sleeve 36 both automatically lock so as to maintain a maximum electrical clearance between the terminals 40 and 68, is important since when the circuit of the isolating device 10 is open, the conducting part 25 is still at line voltage while the conducting part 20 is not at line voltage. The locking feature thus maintains a maximum electrical clearance so as to avoid arcing between the terminals 40 and 68. When the apparatus is lowered to the ground, it can be manually reset by releasing the pins 52 and 76.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. A portable circuit interrupting apparatus for use in association with a circuit isolating device of the type which includes a ring-like conducting part and a hook-like conducting part which are relatively moveable between a contacting position for establishing a closed circuit through the device, and a separated position for establishing an open circuit through the device, said circuit interrupting apparatus comprising a tubular housing defining a central axis, a sleeve coaxially mounted to said housing and so as to be slidable between an inserted position and a withdrawn position, and spring biasing means for biasing said sleeve in a first direction extending from said withdrawn position toward said inserted position, a hook engaging terminal, and means mounting said hook engaging terminal to said sleeve, an elongate ring engaging terminal defining a terminal axis, and means mounting said ring engaging terminal to said housing such that said terminal axis at all times substantially perpendicularly intersects said central axis, said means mounting said ring engaging terminal to said housing comprising a tubular cylinder fixed to said tubular housing, a shuttle slidably mounted in said tubular cylinder, second spring biasing means for biasing said shuttle in a second direction which is opposite said first direction, and with said ring engaging terminal being fixed to said shuttle, means for automatically and releasably locking said sleeve in said withdrawn position so as to maintain a maximum electrical clearance between said ring engaging terminal and said hook engaging terminal, shunting circuit means connected between said ring engaging terminal and said hook engaging terminal and including a circuit segment positioned within said housing and sleeve, and means for automatically interrupting said circuit segment upon said sleeve being moved to and reaching said withdrawn position, and a line pole connector arm including means for attaching an elongate line pole thereto, and means mounting said line pole connector arm to said housing, such that in use the line pole is manually engaged by an operator of said apparatus and the apparatus can be remotely manipulated by the operator.

2. The circuit interrupting apparatus as defined in claim 1 wherein said means mounting said line pole connector arm to said housing comprises means pivotally mounting said line pole connector arm to said shuttle so as to be pivotable about an axis which perpendicularly intersects said central axis of said housing.

3. The circuit interrupting apparatus as defined in claim 1 further comprising means for releasably locking the shuttle in an upper position which is relatively close to said hook engaging terminal, and means for automatically and releasably locking the shuttle in a lower position which is relatively remote from said hook engaging terminal.

4. The circuit interrupting apparatus as defined in claim 1 wherein said ring engaging terminal comprises an elongate rod-like member which is essentially linear and includes a pair of spaced apart locating discs at a medial location along its length.

5. The circuit interrupting apparatus as defined in claim 4 wherein said hook engaging terminal comprises a closed ring-like member.

6. A portable circuit interrupting apparatus for use in association with a circuit isolating device of the type which includes a ring-like conducting part and a hook-like conducting part which are relatively moveable between a contacting position for establishing a closed circuit through the device, and a separated position for establishing an open circuit through the device, said circuit interrupting apparatus comprising a tubular housing defining a central axis, a sleeve coaxially mounted to said housing and so as to be slidable between an inserted position and a withdrawn position, and spring biasing means for biasing said sleeve in a first direction extending from said withdrawn position toward said inserted position, a hook engaging terminal, and means mounting said hook engaging terminal to said sleeve, a ring engaging terminal, and means mounting said ring engaging terminal to said housing and comprising a tubular cylinder fixed and generally parallel to said tubular housing, a shuttle slidably mounted in said tubular cylinder for movement between an upper position which is relatively close to said hook engaging terminal and a lower position relatively remote from said hook engaging terminal, second spring biasing means for biasing said shuttle toward said upper position, and with said ring engaging terminal being fixed to said shuttle so as to extend radially outwardly from said tubular cylinder, shunting circuit means connected between said ring engaging terminal and said hook engaging terminal and including a circuit segment positioned within said housing and sleeve, and means for automatically interrupting said circuit segment upon said sleeve being moved to and reaching said withdrawn position, and a line pole connector arm including means for attaching an elongate line pole thereto, and means mounting said line pole connector arm to said shuttle, such that in use the line pole is manually engaged by an operator of said apparatus and the apparatus can be remotely manipulated by the operator.

7. The circuit interrupting apparatus as defined in claim 6 further comprising means for automatically and releasably locking said sleeve in said withdrawn position, means for releasably locking said shuttle in said upper position, and means for automatically and releasably locking said shuttle in said lower position.

8. The circuit interrupting apparatus as defined in claim 7 wherein said means mounting said line pole connector arm to said shuttle includes a pivotal connection therebetween so as to permit pivotal movement about an axis which extends radially outwardly from said tubular cylinder.

9. The circuit interrupting apparatus as defined in claim 8 wherein said line pole connector arm is positioned on a side of said ring engaging terminal which is opposite said hook engaging terminal.

10. The circuit interrupting apparatus as defined in claim 9 wherein said ring engaging terminal comprises an elongate rod-like member which defines a terminal axis, and wherein said shuttle is slidably mounted in said tubular cylinder so that the terminal axis at all times perpendicularly intersects said central axis of said tubular housing.

11. The circuit interrupting apparatus as defined in claim 10 wherein said pivotal connection between said line pole connector arm and said shuttle defines a pivotal axis which at all times perpendicularly intersects said central axis of said housing.

12. In combination, a circuit isolating device comprising a ring-like conducting part and a hook-like conducting part which are relatively moveable between a contacting position for establishing a closed circuit through the device, and a separated position for establishing an open circuit through the device, and a portable circuit interrupting apparatus comprising (a) a tubular housing defining a central axis, (b) a sleeve coaxially mounted to said housing and so as to be slidable between an inserted position and a withdrawn position, and spring biasing means for biasing said sleeve in a first direction extending from said withdrawn position toward said inserted position, (c) an elongate ring engaging terminal mounted to said tubular housing so as to extend radially outwardly from said tubular housing, (d) a hook engaging terminal mounted to said tubular housing so as to extend radially outwardly from said tubular housing, (e) shunting circuit means connected between said ring engaging terminal and said hook engaging terminal and including a circuit segment positioned within said housing and sleeve, and means for automatically interrupting said circuit segment upon said sleeve being moved to and reaching said withdrawn position, and (f) a line pole connector arm including means for attaching an elongate line pole thereto, and means mounting said line pole connector arm to said housing, such that the line pole is adapted to be manually engaged by the operator of said apparatus and the apparatus can be remotely manipulated by the operator, said ring engaging terminal comprising an elongate rod-like member which is essentially linear and includes a pair of axially spaced apart locating discs at a medial location along its length, and wherein said hook engaging terminal comprises a closed ring-like member, said ring engaging terminal and said hook engaging terminal being oriented with respect to each other and separated a predetermined distance from each other when said sleeve is in said inserted position so as to permit said ring engaging terminal to enter said ring-like conducting part of said circuit isolating device and thereby guide the hook engaging terminal into operative engagement with the hook-like conducting part of said circuit isolating device upon a continuous lateral thrust of said circuit interrupting apparatus toward said circuit isolating device.

13. The combination as defined in claim 12 wherein said ring engaging terminal extends radially outwardly a distance from said central axis which is at least about twice the distance the hook engaging terminal extends from said central axis.

14. A portable circuit interrupting apparatus for use in association with a circuit isolating device of the type which includes a ring-like conducting part and a hook-like conducting part which are relatively moveable between a contacting position for establishing a closed circuit through the device, and a separated position for establishing an open circuit through the device, said circuit interrupting apparatus comprising a tubular housing defining a central axis, a sleeve coaxially mounted to said housing and so as to be slidable between an inserted position and a withdrawn position, and spring biasing means for biasing said sleeve in a first direction extending from said withdrawn position toward said inserted position, a hook engaging terminal, and means mounting said hook engaging terminal to said sleeve, an elongate ring engaging terminal which comprises an elongate rod-like member which is essentially linear and includes a pair of spaced apart locating discs at a medial location along its length, and such that the ring engaging terminal defines a terminal axis, and means mounting said ring engaging terminal to said housing such that said terminal axis at all times substantially perpendicularly intersects said central axis, shunting circuit means connected between said ring engaging terminal and said hook engaging terminal and including a circuit segment positioned within said housing and sleeve, and means for automatically interrupting said circuit segment upon said sleeve being moved to and reaching said withdrawn position, and a line pole connector arm including means for attaching an elongate line pole thereto, and means mounting said line pole connector arm to said housing, such that in use the line pole is adapted to be manually engaged by an operator of said apparatus and the apparatus can be remotely manipulated by the operator.

15. The circuit interrupting apparatus as defined in claim 14 wherein said hook engaging terminal comprises a closed ring-like member.

16. The circuit interrupting apparatus as defined in claim 14 wherein said means mounting said ring engaging terminal to said housing comprises a tubular cylinder fixed and generally parallel to said tubular housing, a shuttle slidably mounted in said tubular cylinder, second spring biasing means for biasing said shuttle in a second direction which is opposite said first direction, and with said ring engaging terminal being fixed to said shuttle.

17. The circuit interrupting apparatus as defined in claim 16 further comprising means for releasably locking the shuttle in an upper position which is relatively close to said hook engaging terminal, and means for automatically and releasably locking the shuttle in a lower position which is relatively remote from said hook engaging terminal.

* * * * *